United States Patent [19]

Waltenspühl

[11] Patent Number: 4,708,327

[45] Date of Patent: Nov. 24, 1987

[54] DISCHARGE NOZZLE ASSEMBLY AND METHODS OF FORMATION AND OPERATION THEREOF

[75] Inventor: Rolf Waltenspühl, Hünenberg, Switzerland

[73] Assignee: Stopinc Aktiengesellschaft, Baar, Switzerland

[21] Appl. No.: 839,179

[22] Filed: Mar. 13, 1986

[30] Foreign Application Priority Data

Apr. 11, 1985 [DE] Fed. Rep. of Germany ..... 3512907

[51] Int. Cl.[4] ..... C21C 5/48

[52] U.S. Cl. ..... 266/220; 266/236; 222/603

[58] Field of Search ..... 266/220, 217, 236; 222/603; 264/30

[56] References Cited

U.S. PATENT DOCUMENTS 3,773,226 11/1973 Kutzer ..... 266/220
3,838,798 10/1974 Voss ..... 222/603
4,091,971 5/1978 Tinnes et al. ..... 222/603
4,360,190 11/1982 Ato ..... 266/220
4,583,721 4/1986 Arakawa et al. ..... 266/220

FOREIGN PATENT DOCUMENTS 1270625 7/1961 France ..... 266/220

*Primary Examiner*—L. Dewayne Rutledge
*Assistant Examiner*—S. Kastler
*Attorney, Agent, or Firm*—Wenderoth, Lind & Ponack

[57] ABSTRACT

A discharge nozzle assembly for discharging molten metal from a metallurgical vessel includes a refractory nozzle brick having therethrough a discharge passage. An annular member formed of a refractory gas-permeable material is embedded in the nozzle brick and has an inner surface defining a discharge passage aligned with the discharge passage of the nozzle brick. A processing gas is supplied to the annular, gas-permeable member which supplies such gas to the discharge passage. The annular member is encased in metal, except for the inner surface thereof, to prevent leakage of the gas.

6 Claims, 3 Drawing Figures

DISCHARGE NOZZLE ASSEMBLY AND METHODS OF FORMATION AND OPERATION THEREOF

BACKGROUND OF THE INVENTION

The present invention relates to a discharge nozzle assembly for use in discharging molten metal from a metallurgical vessel, and specifically of the type including means for supplying a processing gas into a delivery channel of a refractory nozzle brick of the assembly.

In a casting tube for pouring ladles or in a tundish in a continuous casting plant, is known to introduce a processing gas, such as an inert gas for the casting of primarily aluminum-killed molten steels, into the delivery channel or discharge passage of a refractory nozzle brick in order to prevent the gradual clogging of the delivery channel as a result of the formation of alumina formed during the casting of such molten steels.

Austrian Patent No. 321,480 discloses a prior art apparatus of this general type wherein there are provided two refractory nozzle brick sleeves enclosing a delivery channel concentrically and consisting of differently gas-permeable refractory materials in communication with an annular chamber connected to a gas inlet pipe. Thus, processing gas makes its way from the casting tube to the metallurgical vessel containing the molten metal via a more strongly gas-permeable outer refractory nozzle brick sleeve, and via the less strongly gas-permeable inner refractory nozzle brick sleeve, to the delivery channel. However, considerable leakage losses occur as a result of the high temperatures to which the parts are subjected during operation, particularly around the delivery channel between the outer nozzle brick sleeve and a metal annular chamber enclosing it on the lower side. These leakage losses also occur at a bolted joint between the annular chamber and the gas inlet pipe. As a result, the effective amount of a gas to be injected cannot be determined accurately, and this therefore results in a relatively high consumption of the expensive gas. Furthermore, it has been found that the conventional funnel-shaped upper end of the delivery channel in conventional arrangements is disadvantageous in that it results in eddy currents and turbulence in the molten metal in such funnel-shaped inlet end, thereby reinforcing the tendency of the occurrence of clogging.

SUMMARY OF THE INVENTION

Accordingly, it is an object of the present invention to provide a discharge nozzle assembly for discharging molten metal from a metallurgical vessel, whereby it is possible to prevent clogging, while overcoming the above and other prior art disadvantages.

It is a further object of the present invention to provide such an assembly whereby it is possible to prevent leakage losses of the gas.

It is a still further object of the present invention to provide such an assembly of a construction such that the refractory nozzle brick, due to the necessity of replacing it frequently, can be manufactured easily and can be exchanged readily.

It is a further object of the present invention to provide a method for the easy and accurate formation of such an assembly.

It is an even still further object of the present invention to provide an improved method of discharging molten metal from a metallurgical vessel while preventing a reduction of the cross section of the discharge passage due to clogging thereof by the supply of a gas, while avoiding leakage losses of such gas.

The above objects are achieved in accordance with one aspect of the present invention by the provision of a discharge nozzle assembly for discharging molten metal from a metallurgical vessel, the assembly including a refractory nozzle brick having therethrough a discharge passage, an annular member formed of a refractory gas-permeable material embedded in the nozzle brick and having an inner surface defining a discharge passage aligned with the discharge passage of the nozzle brick, an outer surface and spaced end surfaces, metal means for encasing the outer surface and the spaced end surfaces of the member, and means for supplying through the metal means a gas, for example an inert gas, to the member, whereby the gas passes through the member and enters the discharge passage from the inner surface of the member, and the gas is prevented by the metal means from leaking from the member in directions other than radially inwardly therefrom into the discharge passage.

In accordance with a particularly preferred feature of the present invention, the metal means is spaced radially outwardly of the outer surface of the member, thereby defining an annular space radially outwardly of the member.

The metal means may be a metal casing embedded in the refractory material of the nozzle brick. Alternatively, the metal means may be formed by a portion of a metal jacket surrounding the nozzle brick and by radially inwardly extending flanges welded to such jacket portion with the member positioned axially between such annular flanges. The gas supplying means may include a tubular member welded to the metal means. In a preferred arrangement, the tubular member is welded at opposite ends thereof to the metal casing and the metal jacket, such that the tubular member is embedded in the refractory material of the nozzle brick.

In accordance with a further aspect of the present invention, involving the formation of the assembly, the tubular member is connected to the metal jacket and the metal casing, thereby suspending the metal casing within the metal jacket, and thereafter the refractory material to form the nozzle brick is cast into the metal jacket and around the tubular member and the metal casing, while providing the mold to form the discharge passage, thereby forming the nozzle brick with the metal casing embedded therein.

In accordance with a further aspect of the present invention, there is provided an improved method for discharging molten metal from a metallurgical vessel through a discharge passage in a refractory nozzle brick, while preventing clogging of the discharge passage by providing in the nozzle brick the annular member formed of a refractory gas-permeable material, supplying a gas, for example an inert gas, through the member and into the discharge passage, and preventing or at least substantially avoiding leakage of the gas from the member in directions other than radially inwardly therefrom into the discharge passage by encasing the outer surface and spaced end surfaces of the member in a metal casing.

BRIEF DESCRIPTION OF THE DRAWINGS

Other objects, features and advantages of the present invention will be apparent from the following detailed description of various embodiments thereof, with reference to the accompanying drawings, wherein.

DETAILED DESCRIPTION OF THE INVENTION

Figure 1:
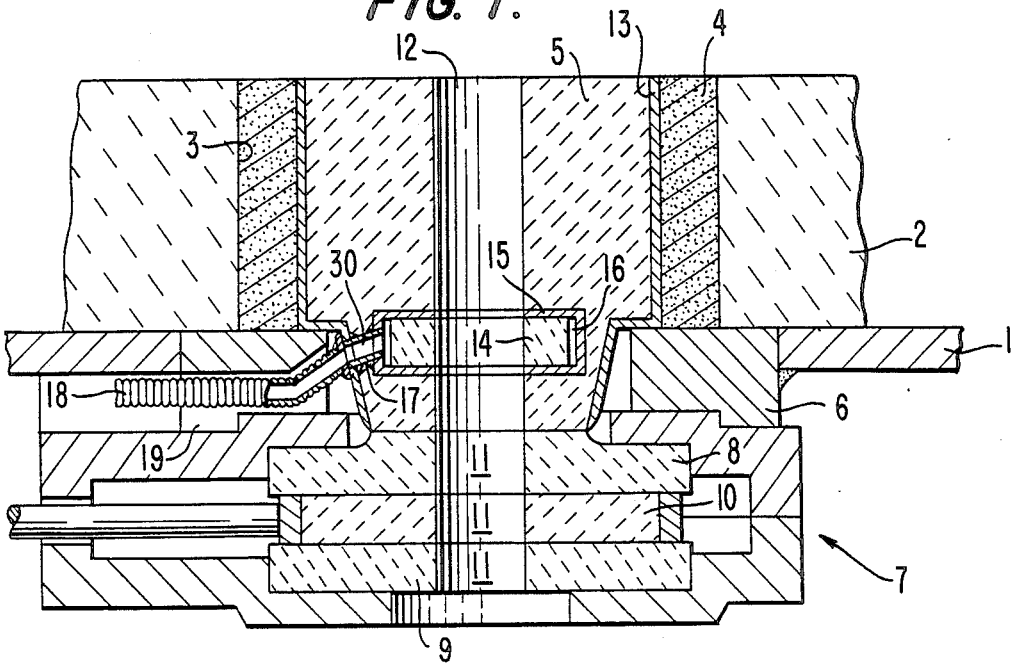
FIG. 1 is a vertical section through the lower portion of a metallurgical vessel having therein a discharge nozzle assembly according to a first embodiment of the present invention, the metallurgical vessel further being shown equipped with a conventional sliding closure unit for controlling the discharge of the molten metal.

In FIG. 1 is shown a portion of the bottom of a metallurgical vessel including a metal jacket 1 and a refractory lining 2. In an opening 3 in refractory lining 2 is positioned, for example with the use of a relatively thick tamping clay 4, a refractory nozzle brick 5, in the form of a sleeve and supported on a metal ring 6 welded to metal jacket 1. Nozzle brick 5 has therethrough a discharge opening 12 for discharge of molten metal from the metallurgical vessel, and also illustrated in FIG. 1 is a conventional sliding closure unit 7 for use in controlling discharge of the molten metal. Sliding closure unit 7 is shown somewhat schematically and is intended to be any conventional such structure. The illustrated sliding closure unit includes two stationary refractory plates 8, 9 having therethrough respective discharge openings 11 aligned with discharge passage 12 and a movable refractory plate 10 positioned between stationary refractory plate 8, 9 and having therethrough a discharge opening 11. Movable refractory plate 10 is movable in a normal manner between an open position, shown in FIG. 1, wherein the discharge opening 11 of movable refractory 10 aligns with the discharge openings of the stationary refractory plates and the discharge passage 12, and a closed position whereat the discharge openings are out of alignment and plate 10 closes the discharge opening of plate 8 and discharge passage 12 of nozzle brick 5.

In accordance with one embodiment of the present invention, refractory nozzle brick 5 is part of a discharge nozzle assembly which also includes a metal jacket 13 surrounding the outer surface of nozzle brick 5. An annular member 14 formed of a refractory gas-permeable material is positioned within an inner recess in nozzle brick 5, and member 14 has an inner surface defining a discharge passage aligned with discharge passage 12 of nozzle brick 5. Member 14 has an outer surface and axially spaced end surfaces which are encased by an annular metal casing 15. A connecting member 17 in the form of a tubular member 30 is connected, for example by welding, at opposite ends thereof to metal jacket 13 and metal casing 15. Thus, tubular member 30 extends through a portion of the refractory material of nozzle brick 5 in a generally radial or tangential direction. Tubular member 30 opens outwardly of the metal jacket 13 and is connected, for example by welding, to a flexible inlet pipe, such as a thin pipe or copper tube 18 which may be connected to a source of processing gas, for example an inert gas. The inert gas thereby is supplied through tube 18 and tubular member 30 into an annular space 16 radially outwardly of member 14 and radially inwardly of casing 15. Such gas then is passed through the gas-permeable porous material of member 14 and is supplied to discharge passage 12, thereby preventing clogging of such passage.

In accordance with the present invention, the metal casing 15 prevents the gas from leaking from member 14 in directions other than radially inwardly therefrom into discharge passage 12. Since pipe or tube 18 is welded or soldered to connecting member 17, it is not necessary to provide such connection in the form of a bolted connection. This eliminates gas leakage losses at the connection area. Since pipe or tube 18 is flexible, it may pass through a groove 19 formed in metal ring 6 and other exterior portions of the apparatus. This makes it relative easy to replace the assembly, it being kept in mind that the nozzle brick 5 normally must be exchanged relatively frequently.

Furthermore, the discharge nozzle assembly of FIG. 1 may be manufactured relatively simply, and this is of particular advantage since the nozzle brick 5 has a relatively short service life. Thus, metal jacket 13 may essentially serve as a mold, with metal casing 15 supporting member 14 suspended within metal jacket 13 by welding connecting piece 17 at opposite ends thereof to metal jacket 13 and metal casing 15. The refractory material to form nozzle brick 5 then is cast into the metal jacket and around the connecting piece and metal casing, thereby forming the nozzle brick with the metal casing 15 embedded therein. It of course will be understood that it is necessary to provide mold elements to form the discharge passage and the bottom surface of the nozzle brick. The flexible conduit 18 then is welded or soldered to connecting piece 17 protruding from metal jacket 13.

Figure 2:
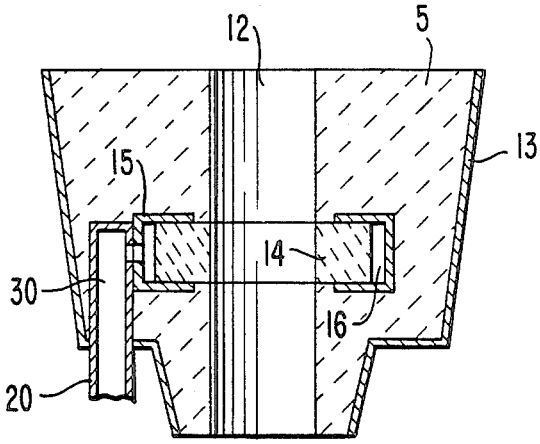
FIG. 2 is a vertical section through a discharge nozzle assembly according to a second embodiment of the present invention.

FIG. 2 illustrates a second embodiment of the present invention which also can be manufactured easily. This embodiment differs from the embodiment of FIG. 1 in a number of respects, any of which may be employed in a particular discharge nozzle assembly. Thus, the outer configuration of the nozzle brick 5 may be somewhat conical as shown in FIG. 2. Also, the connecting member or tubular member 30 may be in the form of a copper tube 20 which extends parallel to the axis of discharge passage 12 and which extends outwardly from the refractory material of the nozzle brick in a downward direction. The upper end of tube 20 is soldered or welded to metal casing 15, and openings pass therethrough to deliver the gas to the annular space 16 and to member 14.

Figure 3:
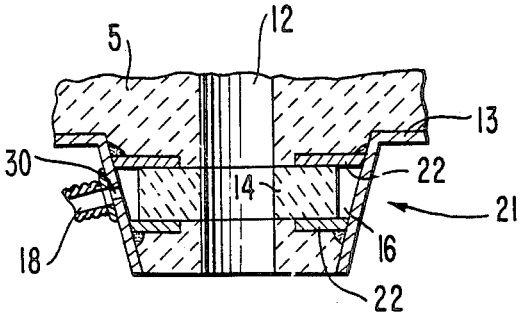
FIG. 3 is a partial vertical section through a discharge nozzle assembly according to a third embodiment of the present invention.

FIG. 3 illustrates a third embodiment of the present invention wherein there is not provided a separate metal casing 15. Rather, a portion of the metal jacket 13 surrounds the annular space 16, and a pair of axially spaced annular flanges 22 are welded to metal jacket 13 and extend radially inwardly thereof. Member 14 is positioned axially between the annular flanges 22, such that the flanges 22 and the portion of metal jacket 13 form an encasement of member 14 to prevent gas leakage therefrom in any direction other than radially inwardly into discharge passage 12.

During operation of the discharge nozzle assembly of the present invention, a processing gas, for example an inert gas such as argon, is injected from a gas source through tube 18 and connecting piece 30 into space 16 and then passes through member 14 into discharge passage 12. A fraction of the gas may be injected in a pulse-like manner. For practical reasons, the processing gas also can be heated. It has been found that with this mode of operation it is possible to increase the casting time during which the casting can be effected without difficulties resulting from possible clogging of the discharge passage. Since this operation is carried out with very small quantities of gas, such as 4 to 6 Nl/min, the fact that losses of the gas from leakage are ruled out almost completely contributes to successful operation.

Although the present invention has been described and illustrated with respect to preferred features thereof, it is to be understood that various modifications may be made to the specifically described and illustrated features without departing from the scope of the present invention.

I claim:

1. A discharge nozzle assembly for discharging molten metal from a metallurgical vessel, said assembly comprising:

a refractory nozzle brick having therethrough a discharge passage and having an outer surface;

a metal jacket surrounding said outer surface of said nozzle brick;

an annular member, formed of a refractory gas-permeable material, embedded in said nozzle brick and having an inner surface defining a discharge passage aligned with said discharge passage of said nozzle brick and spaced end surfaces confronting respective surfaces of said nozzle brick and an outer surface;

means for supplying a gas to said outer surface of said annular member, such that said gas passes through said annular member and enters said discharge passage from said inner surface of said annular member; and means for preventing said gas from leaking from said annular member in directions other than radially inwardly therefrom into said discharge passage, said preventing means comprising a portion of said metal jacket surrounding said outer surface of said annular member and axially spaced annular metal flanges welded to said metal jacket and extending radially inwardly therefrom into said nozzle brick, with said annular member positioned axially between said pair of metal flanges, said portion of said metal jacket and said pair of metal flanges defining metal means encasing said outer surface and said spaced end surfaces of said annular member.

2. An assembly as claimed in claim 1, wherein said portion of said metal jacket is spaced radially outwardly of said outer surface of said annular member, thereby defining an annular space radially outwardly of said annular member.

3. An assembly as claimed in claim 1, wherein said gas supplying means comprises an opening through said portion of said metal jacket.

4. An assembly as claimed in claim 3, further comprising a flexible inlet pipe connected to the outer surface of said metal jacket and surrounding said opening.

5. An assembly as claimed in claim 1, wherein said discharge passage through said nozzle brick and said annular member has a substantially round transverse cross-sectional configuration.

6. A method of forming a discharge nozzle assembly for discharging molten metal from a metallurgical vessel and of the type including a refractory nozzle brick having therethrough a discharge passage, a metal jacket surrounding the outer surface of said nozzle brick, a metal casing embedded in the refractory material of said nozzle brick and supporting an annular member formed of a refractory gas-permeable material and having therethrough a discharge passage aligned with said discharge passage of said nozzle brick, and a tubular member having opposite ends fixed to said metal jacket and said metal casing for supplying gas to said member, said method comprising:

connecting said tubular member to said metal jacket and said metal casing, thereby suspending said metal casing within said metal jacket; and casting the refractory material to form said nozzle brick in said metal jacket and around said tubular member and said metal casing, while providing a mold to form said discharge passage, thereby forming said nozzle brick with said metal casing embedded therein.

* * * * *